US007325906B2

(12) United States Patent
Furukawa

(10) Patent No.: US 7,325,906 B2
(45) Date of Patent: Feb. 5, 2008

(54) INK JET HEAD AND INK JET RECORDING APPARATUS

(75) Inventor: Koji Furukawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 211 days.

(21) Appl. No.: 10/946,059

(22) Filed: Sep. 22, 2004

(65) Prior Publication Data

US 2005/0062787 A1 Mar. 24, 2005

(30) Foreign Application Priority Data

Sep. 24, 2003 (JP) ..... 2003-331236

(51) Int. Cl.
*B41J 2/05* (2006.01)
*B41J 2/015* (2006.01)
*B41J 2/41* (2006.01)

(52) U.S. Cl. ..... 347/67; 347/20; 347/112

(58) Field of Classification Search ..... 347/7, 347/20, 12, 14, 44, 47, 112, 127, 128, 67
See application file for complete search history.

(56) References Cited

U.S. PATENT DOCUMENTS 6,158,844 A 12/2000 Murakami et al.

FOREIGN PATENT DOCUMENTS

| | | | |
|---|---|---|---|
| EP | 0 703 081 | A2 | 3/1996 |
| EP | 0 827 831 | A2 | 3/1998 |
| JP | 10-138493 | A | 5/1998 |
| JP | 2000-6419 | A | 1/2000 |
| WO | WO 01/47715 | A1 | 7/2001 |

OTHER PUBLICATIONS

"Electrophotography—Bases and Applications", edited by The Imaging Society of Japan, and published by Corona Publishing Co., Ltd., pp. 497 to 505, 1998.

*Primary Examiner*—Shih-Wen Hsieh
(74) *Attorney, Agent, or Firm*—Sughrue Mion, Pllc.

(57) ABSTRACT

The ink jet recording apparatus serves to record an image corresponding to image data on a recording medium using an ink jet head which ejects ink in the form of an ink droplet. The ink jet head includes an ejection orifice substrate in which an ejection orifice is bored, a head substrate disposed at a predetermined distance from the ejection orifice substrate to define an ink passage between the ejection orifice substrate and the head substrate, ejection control device which controls the ejection of the ink from the ejection orifice. The ink guide dike is provided on a surface of the head substrate on a side of the ink passage to form an ink flow directed from an upstream side of the ejection orifice in the ink passage to the ejection orifice.

17 Claims, 7 Drawing Sheets

INK JET HEAD AND INK JET RECORDING APPARATUS

BACKGROUND OF THE INVENTION

The present invention relates to an ink jet head for ejecting ink to fly the ejected ink toward a recording medium, and an ink jet recording apparatus for recording an image corresponding to image data on a recording medium using the ink jet head.

An ink jet recording apparatus serves to eject ink through ejection orifices to record an image corresponding to image data on a recording medium. Examples of known ink jet recording apparatuses include an electrostatic type, thermal type, and piezo type ink jet recording apparatuses which are classified depending on differences of means for controlling ejection of ink.

Hereinafter, the electrostatic ink jet recording apparatus will be described as an example. The electrostatic ink jet recording apparatus is such that ink containing charged color particles is used, and predetermined voltages are respectively applied to ejection portions of an ink jet head in correspondence to image data, whereby ejection of the ink from the ink jet head is controlled by utilizing electrostatic forces to record an image corresponding to the image data on a recording medium. Known as an example of the electrostatic ink jet recording apparatus is an ink jet recording apparatus disclosed in JP 10-138493 A.

FIG. 7 is a schematic view showing a construction of an example of an ink jet head of an electrostatic ink jet recording apparatus disclosed in JP 10-138493 A. In an ink jet head 80 shown in the figure, only one ejection portion of the ink jet head disclosed in JP 10-138493 A is conceptually shown. The ink jet head 80 includes a head substrate 82, an ink guide 84, an insulating substrate 86, a control electrode 88, a counter electrode 90, a D.C. bias voltage source 92, and a pulse voltage source 94.

Here, the ink guide 84 is disposed on the head substrate 82, and a through hole (ejection orifice) 96 is bored through the insulating substrate 86 so as to correspond in position to the ink guide 84. The ink guide 84 extends through the through hole 96, and its projecting tip portion 84*a* projects upwardly and beyond a surface of the insulating substrate 86 on a side of a recording medium P. In addition, the head substrate 82 is disposed at a predetermined distance from the insulating substrate 86. Thus, a passage 98 of ink Q is defined between the head substrate 82 and the insulating substrate 86.

The control electrode 88 is provided in a ring-like shape on the surface of the insulating substrate 86 on the side of the recording medium P so as to surround the periphery of the through hole 96 of every ejection portion. In addition, the control electrode 88 is connected to the pulse voltage source 94 for generating a pulse voltage in correspondence to image data. The pulse voltage source 94 is grounded through the D.C. bias voltage source 92.

In addition, the counter electrode 90 is disposed in a position facing the tip portion 84*a* of the ink guide 84 and is grounded. The recording medium P is disposed on a surface of the counter electrode 90 on a side of the ink guide 84. That is to say, the counter electrode 90 functions as a platen for supporting the recording medium P.

During the recording, the ink Q containing color particles which are charged at the same polarity as that of a voltage applied to the control electrode 88 is made to circulate through the ink passage 98 from the right-hand side to the left-hand side in the figure by a circulation mechanism for ink (not shown). In addition, a high voltage of 1.5 kV for example is continuously applied to the control electrode 88 by the D.C. bias voltage source 92. At this time, part of the ink Q within the ink passage 98 passes through the through hole 96 of the insulating substrate 86 by a capillary phenomenon or the like to be concentrated at the tip portion 84*a* of the ink guide 84.

If a pulse voltage of 0 V for example is applied from the pulse voltage source 94 to the control electrode 88 biased at 1.5 kV by the bias voltage source 92, then a voltage of 1.5 kV obtained by superposing both the voltages on each other is applied to the control electrode 88. In this state, an electric field strength in the vicinity of the tip portion 84*a* of the ink guide 84 is relatively low, and hence the ink Q containing the charged color particles which are concentrated at the tip portion 84*a* of the ink guide 84 is not flied out from the tip portion 84*a* of the ink guide 84.

On the other hand, if a pulse voltage of 500 V for example is applied from the pulse voltage source 94 to the control electrode 88 biased at 1.5 kV, then a voltage of 2 kV obtained by superposing both the voltages on each other is applied to the control electrode 88. As a result, the ink Q containing the charged color particles which are concentrated at the tip portion 84*a* of the ink guide 84 is flied out in a form of an ink droplet R from the tip portion 84*a* of the ink guide 84 by the electrostatic force, and be electrostatically drawn by the grounded counter electrode 90 to be stuck onto the recording medium P to form thereon a dot of the charged color particles.

In such a manner, a recording is carried out with the dots of the charged color particles while the ink jet head 80 and the recording medium P supported on the counter electrode 90 are relatively moved to thereby record an image corresponding to the image data on the recording medium P.

Now, in the electrostatic ink jet head, when a plurality of ejection portions are disposed in a matrix to construct a multi-channel head, it becomes difficult to connect signal wirings to the control electrodes for the respective ejection portions. For this reason, in the case where there is a large number of channels, it is conceivable that the insulating substrate is made in the form of a multilayer wiring structure in order to connect signal wirings to control electrodes. Consequently, in the future, the insulating substrate has a tendency to become gradually thicker along with an increase in the number of channels.

However, since a length of the through hole (ejection orifice) becomes large relatively to an orifice diameter thereof if the insulating substrate is thickened, a resistance between the ink and an inner wall of the through hole becomes large and hence the ink becomes hard to be ejected. In addition, if the insulating substrate is thickened as compared with a velocity of an ink flow, then the ink stays in the through hole to degrade the property of supply of the ink to the tip portion of the ink guide. As a result, there is encountered a problem that responsivity to an ejection frequency becomes poor, and the dot diameter gradually becomes smaller as the drawing speed is further increased.

Note that while not limited to the electrostatic ink jet recording apparatus, when the insulating substrate is thickened, i.e., the length of the through hole becomes large, the same problem occurs in the ink jet recording apparatuses using the various type ink jet heads.

SUMMARY OF THE INVENTION

In order to solve above-mentioned problems associated with the prior art, an object of the present invention is to provide an ink jet head which is capable of enhancing a property of supply of ink to ejection orifices, and of, even when dots are continuously drawn at a high speed, stably drawing the dots each having a desired size, and an ink jet recording apparatus using the ink jet head.

In order to achieve the above-mentioned object, the present invention provides an ink jet head for ejecting ink in the form of an ink droplet to fly the ink droplet toward a recording medium, comprising: an ejection orifice substrate in which an ejection orifice adapted to eject therefrom the ink is bored; a head substrate disposed at a predetermined distance from said ejection orifice substrate to define an ink passage between said ejection orifice substrate and said head substrate; ejection control means for controlling the ejection of the ink from said ejection orifice; and an ink guide dike provided on a surface of said head substrate on a side of said ink passage to form an ink flow directed from an upstream side of said ejection orifice in said ink passage to said ejection orifice.

Preferably, said ink guide dike includes a surface inclining in a direction from said surface of said head substrate on the side of said ink passage to said ejection orifice substrate so as to lead from the upstream side of said ejection orifice in said ink passage toward a position of said ejection orifice.

Preferably, the ink jet head further comprises an ink guide projection disposed on said head substrate so as to extend through a central portion of said ejection orifice with its tip being directed in a direction of the ejection of the ink, and said ink guide dike is provided so as to contact said ink guide projection.

Preferably, the ink jet head further comprises an ink guide groove formed in a surface of said ejection orifice substrate on the side of said ink passage so as to lead from the upstream side of said ejection orifice in said ink passage to said ejection orifice.

Preferably, the ink contains a solvent and color particles dispersed in said solvent; said ejection control means is comprised of an ejection electrode; and an electrostatic force is made to act on the ink by said ejection electrode to eject the ink in the form of the ink droplet, thereby flying the ink droplet toward said recording medium.

Preferably, said ejection orifice substrate includes an insulating substrate and at least one layer of said ejection electrode provided on a surface of at least one of a side of said ink passage of said insulating substrate and a side of said recording medium of said insulating substrate so as to surround a periphery of said ejection orifice.

Preferably, said ejection electrode is formed into a circular arc shape with its part of the electrode on the upstream side of said ejection orifice in said ink passage being removed; and said ink guide groove is formed so as to extend through said removed portion of said ejection electrode to reach in depth a position nearer said recording medium than said ejection electrode formed in the position nearest said recording medium.

Also, the present invention provides an ink jet recording apparatus for recording an image corresponding to image data on a recording medium using an ink jet head for ejecting ink in the form of an ink droplet, said ink jet head comprising: an ejection orifice substrate in which an ejection orifice adapted to eject therefrom the ink is bored; a head substrate disposed at a predetermined distance from said ejection orifice substrate to define an ink passage between said ejection orifice substrate and said head substrate; ejection control means for controlling the ejection of the ink from said ejection orifice; and an ink guide dike provided on a surface of said head substrate on a side of said ink passage to form an ink flow directed from an upstream side of said ejection orifice in said ink passage to said ejection orifice.

Preferably, said ink guide dike includes a surface inclining in a direction from said surface of said head substrate on the side of said ink passage to said ejection orifice substrate so as to lead from the upstream side of said ejection orifice in said ink passage toward a position of said ejection orifice.

Preferably, the ink jet recording apparatus further comprises an ink guide projection disposed on said head substrate so as to extend through a central portion of said ejection orifice with its tip being directed in a direction of the ejection of the ink, wherein said ink guide dike is provided so as to contact said ink guide projection.

Preferably, the ink jet recording apparatus further comprises an ink guide groove formed in a surface of said ejection orifice substrate on the side of said ink passage so as to lead from the upstream side of said ejection orifice in said ink passage to said ejection orifice.

Preferably, the ink contains a solvent and color particles dispersed in said solvent; said ejection control means is comprised of an ejection electrode; and an electrostatic force is made to act on the ink by said ejection electrode to eject the ink in the form of the ink droplet, thereby flying the ink droplet toward said recording medium.

Preferably, said ejection orifice substrate includes an insulating substrate and at least one layer of said ejection electrode provided on a surface of at least one of a side of said ink passage of said insulating substrate and a side of said recording medium of said insulating substrate so as to surround a periphery of said ejection orifice.

Preferably, said ejection electrode is formed into a circular arc shape with its part of the electrode on the upstream side of said ejection orifice in said ink passage being removed; and said ink guide groove is formed so as to extend through said removed portion of said ejection electrode to reach in depth a position nearer said recording medium than said ejection electrode formed in the position nearest said recording medium.

According to the present invention, the ink guide dike inclining from an upstream side of the ink flow toward the ejection orifice is provided in an area corresponding to the ejection orifice of the head substrate, resulting in that the ink is guided along the ink guide dike to form the ink flow directed to the ejection orifice, and ink supply property to the ejection orifice can be enhanced. Consequently, responsivity to an ejection frequency upon recording an image can be improved, and even when dots are continuously formed at high speed, the reduction of a dot diameter can be suppressed. As a result, the dots each having a desired size can be stably drawn.

This application claims priority on Japanese patent application No.2003-331236, the entire contents of which are hereby incorporated by reference.

DETAILED DESCRIPTION OF THE INVENTION

An ink jet head and an ink jet recording apparatus of the present invention will hereinafter be described in detail on the basis of preferred embodiments with reference to the accompanying drawings.

Figure 1:
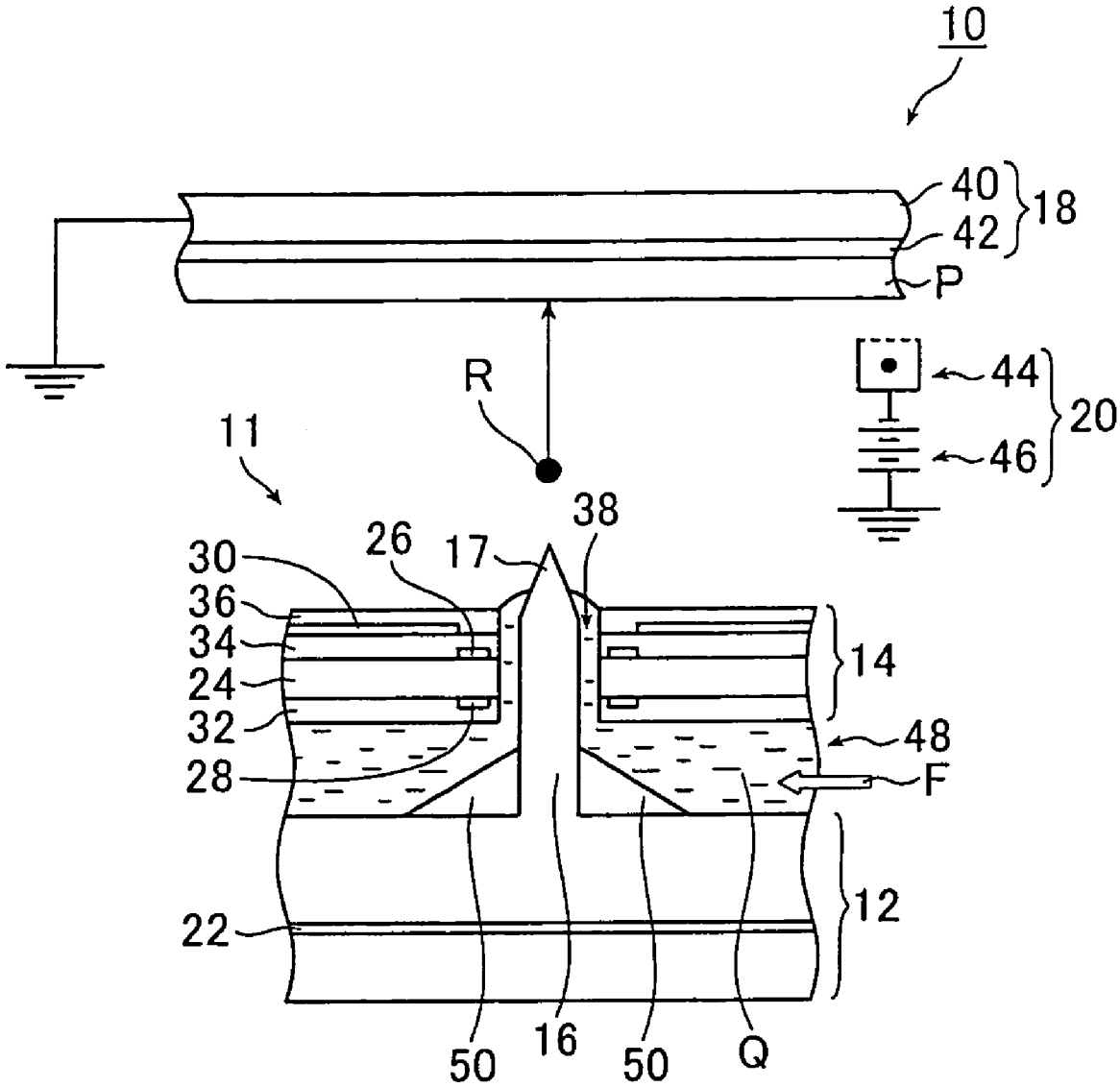
FIG. 1 is a schematic cross sectional view showing a schematic construction of an ink jet head according to an embodiment of the present invention in an ink jet recording apparatus according to the present invention.

FIG. 1 is a schematic cross sectional view showing a part of an ink jet head in an ink jet recording apparatus according to an embodiment of the present invention. An ink jet recording apparatus 10 shown in FIG. 1 is an electrostatic ink jet recording apparatus for recording an image corresponding to image data on a recording medium P using an ink jet head 11 for ejecting ink Q containing color particles such as a pigment which are charged with electricity in the form of an ink droplet R by utilizing an electrostatic force.

Figure 2A:
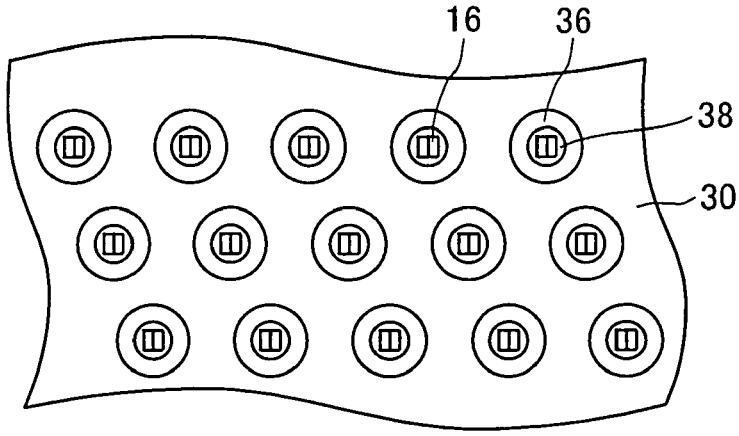
FIG. 2A is a schematic plan views showing disposition of a guard electrode in an ejection orifice substrate of the ink jet head in the ink jet recording apparatus shown in FIG. 1 when viewed from a side of a recording medium P.
Figure 2B:
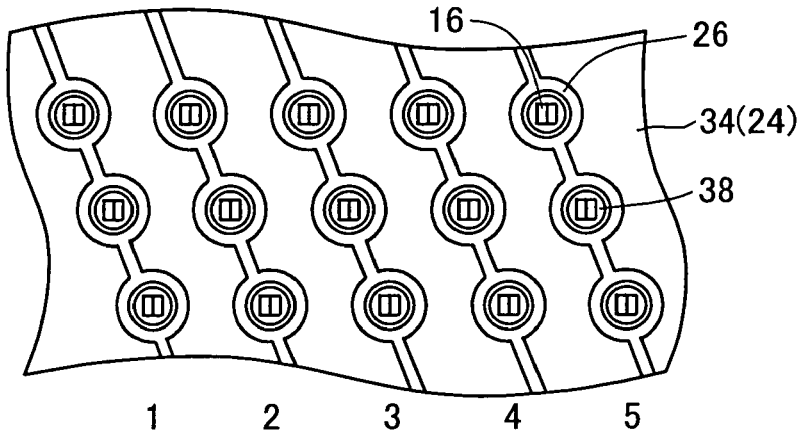
FIG. 2B is a schematic plan views showing disposition of first ejection electrodes in the ejection orifice substrate in FIG. 2A.
Figure 2C:
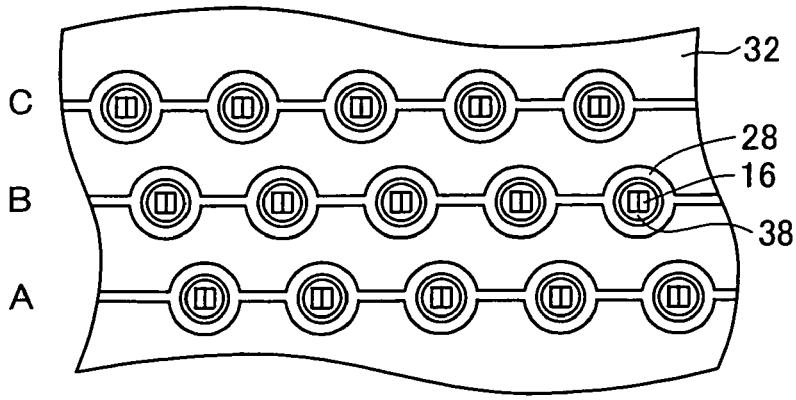
FIG. 2C is a schematic plan views showing disposition of second ejection electrodes in the ejection orifice substrate in FIG. 2A.

The ink jet head 11 has a multi-channel structure in which as shown in FIGS. 2A to 2C, fifteen ejection portions are two-dimensionally disposed. FIG. 1 shows only one ejection portion of the ink jet head 11 in order to simplify a description.

The ink jet head 11 shown in FIG. 1 includes a head substrate 12, an ejection orifice substrate 14, and an ink guide projection 16. In FIG. 1, in addition to the ink jet head 11, a counter electrode 18 and a charging unit 20 for charging the recording medium P are shown as a part of constituent elements of the ink jet recording apparatus 10. In the description below, as shown in FIG. 1, the side of the recording medium P with respect to the ink jet head 11 is called upper side and the side of the head substrate 12 is called lower side under unless otherwise specified.

In the ink jet head 11, firstly, the head substrate 12 is a sheet-like insulating substrate common to all the ejection portions, and a floating conductive plate 22 which is electrically in a floating state is formed on a surface of the head substrate 12.

Generated in the floating conductive plate 22 in recording an image is an induced voltage which is induced in correspondence to voltage values of ejection voltages applied to ejection electrodes for the ejection portions as will be described later. In addition, a voltage value of the induced voltage automatically changes in correspondence to the number of operating channels. The charged color particles contained in the ink Q within an ink passage 48 are energized by the floating conductive plate 22 to migrate to a side of the ejection orifice substrate 14 to be concentrated at a tip portion 17 of the ink guide projection 16. For this reason, a concentration of the charged color particles in the ejected ink Q is usually stabilized at a predetermined concentration.

Note that the floating conductive plate 22 is not an essential constituent element, and hence is preferably provided suitably as may be necessary. In addition, the floating conductive plate 22 has to be disposed on the head substrate 12 side with respect to the ink passage 48. For example, the floating conductive plate 22 may also be disposed inside the head substrate 12. Also, the floating conductive plate 22 is preferably disposed on an upstream side of the ink passage 48 with respect to a position where the ejection portion is disposed. Also, a predetermined voltage may be applied to the floating conductive plate 22.

Next, the ejection orifice substrate 14 is also a sheet-like insulating substrate common to all the ejection portions. Through holes (ejection orifices for the ink) 38 are bored in the ejection orifice substrate 14 in a position corresponding to the ink guide projection 16 of each ejection portion.

The head substrate 12 is disposed at a predetermined distance from the ejection orifice substrate 14. Then, the ink passage 48 through which the ink Q is supplied to the ink guide projection 16 is defined between the head substrate 12 and the ejection orifice substrate 14. The ink Q, while its details will be described later, contains the color particles which are charged at the same polarity as that of the ejection voltages applied to first ejection electrode 26 and second ejection electrode 28. In recording an image, the ink Q is made to circulate through the ink passage 48 in a predetermined direction (e.g., the direction indicated by an arrow F in FIG. 1.) and at a predetermined velocity (e.g., at an ink flow of 200 mm/s).

The ejection orifice substrate 14 includes an insulating substrate 24, the first ejection electrode 26, the second ejection electrode 28, a guard electrode 30, and insulating layers 32, 34, and 36.

The first and second ejection electrodes 26 and 28 are circular electrodes which are provided in ring-like shapes each on an upper surface and a lower surface of the insulating substrate 24 in the figures so as to surround the periphery of the ejection orifices 38 of each of the ejection portions. The upper surface of the insulating substrate 24 and a surface of the first ejection electrode 26 are covered with the insulating layer 34 for protecting these surfaces and obtaining a flattened surface. Likewise, the lower surface of the insulating substrate 24 and a surface of the second ejection electrode 28 are covered with the insulating layer 32 for protecting these surfaces and obtaining a flattened surface.

Note that neither of the first and second ejection electrodes 26 and 28 is limited to the ring-like circular electrode, and hence an electrode having any shape such as a nearly circular electrode, a split circular electrode, a parallel electrode, or a nearly parallel electrode may be adopted for each of the first and second ejection electrodes 26 and 28 as long as the electrode is disposed so as to face the ink guide projection 16.

As shown in FIGS. 2A to 2C, the fifteen ejection portions are disposed in a matrix shape so that the five ejection portions per row (corresponding to a first column, a second column, a third column, a fourth column, and a fifth column) are disposed in a row direction (in a sub-scanning direction), and the three ejection portions per column (corresponding to an A-th row, a B-th row, and a C-th row) are disposed in a column direction (in a main scanning direction).

As shown in FIG. 2B, the first ejection electrodes 26 of the three ejection portions disposed in the first column are connected to one another. This is also applied to the second to fifth columns. In addition, as shown in FIG. 2C, the second ejection electrodes 28 of the five ejection portions disposed in the A-th row are connected to one another. This is also applied to the B-th row and the C-th row. Then, the first and second ejection electrodes 26 and 28 are connected to control means (not shown) for outputting ejection voltages corresponding to image data, respectively.

In addition, the five ejection portions belonging to the A-th row are disposed at predetermined intervals in the row direction. This is also applied to the B-th row and the C-th row. Also, the five ejection portions belonging to the B-th row are disposed at a predetermined distance from the five ejection portions belonging to the A-th row in the column direction, and are also disposed between the five ejection portions belonging to the A-th row and the five ejection portions belonging to the C-th row in the row direction. Likewise, the five ejection portions belonging to the C-th row are disposed at a predetermined distance from the five ejection portions belonging to the B-th row in the column direction, and are also disposed between the five ejection portions belonging to the B-th row and the five ejection portions belonging to the A-th row in the row direction.

In such a manner, the five ejection portions contained in each of the A-th row, the B-th row, and the C-th row are disposed so as to be shifted in the row direction, respectively, whereby one line which is recorded on the recording medium P is divided into three parts in the row direction.

In recording an image, the three first ejection electrodes 26 disposed in the same column are simultaneously driven at the same voltage level. Likewise, the five second ejection electrodes 28 disposed in the same row are simultaneously driven at the same voltage level. In addition, one line recorded on the recording medium P is divided into three groups corresponding to the numbers of rows of the second ejection electrodes 28 in the row direction to be successively recorded in a time division manner. For example, in a case of the example shown in FIGS. 2A to 2C, the A-th row, the B-th row, and the C-th row of the second ejection electrodes 28 are successively driven to thereby record an image for one line on the recording medium P.

Note that the structure of the ejection electrodes is not limited to the two-layer electrode structure having the first and second ejection electrodes 26 and 28, and hence a single-layer electrode structure or a three or more-layer electrode structure may also be adopted for the ejection electrodes.

The guard electrode 30 is a sheet-like electrode common to all the ejection portions, and, as shown in FIG. 2A, has ring-like opening portions which are formed in positions corresponding to the first and second ejection electrodes 26 and 28 which are formed in the peripheries of the ejection orifices 38 of each of the ejection portions. The surface of the insulating layer 34 and an upper surface of the guard electrode 30 are covered with the insulating layer 36 for protecting these surfaces and obtaining a flattened surface. A predetermined voltage is applied to the guard electrode 30 and hence it plays a function of suppressing an electric field interference generated between the ink guide projections 16 of the adjacent ejection portions.

Note that the guard electrode 30 is not an essential constituent element. In addition, in order to shield a repulsion electric field in a direction from the first ejection electrodes 26 or the second ejection electrodes 28 to the ink passage 48, the ejection orifice substrate 14 may be provided with a shielding electrode which is formed on a side of the ink passage 48 with respect to the second ejection electrode 28.

Next, the ink guide projection 16 is a flat plate which is made of ceramics having a predetermined thickness and which has the projecting tip portion 17. The ink guide projections 16 are disposed at the predetermined intervals on the head substrate 12. The ink guide projection 16 extends through the ejection orifice 38 bored in the ejection orifice substrate 14, and its tip portion 17 projects upwardly from the uppermost surface of the ejection orifice substrate 14 on the recording medium P side (corresponding to the upper surface of the insulating layer 36 in FIG. 1).

The ink guide tip portion 17 is formed into nearly a triangle (or a trapezoid) which tapers off towards the counter electrode 18 side. A metal material is preferably evaporated onto the ink guide tip portion (the highest tip portion) 17. The evaporation of the metal material onto the ink guide tip portion 17 is not an essential factor. However, the evaporation of the metal offers an effect that a permittivity of the ink guide tip portion 17 substantially increases to facilitate the generation of a strong electric field.

Note that the shape of the ink guide projection 16 is not especially limited as long as the charged color particles contained in the ink Q can be made to pass through the ejection orifice 38 of the ejection orifice substrate 14 to be concentrated at the tip portion 17. For example, the ink guide tip portion 17 does not necessarily have the projection shape. Thus, the ink guide tip portion 17 may be freely changed. In addition, in order to promote the concentration of the charged color particles at the ink guide tip portion 17, a slit serving as an ink guide groove through which the ink Q is collected at the ink guide tip portion 17 by the capillary phenomenon may be formed vertically at the central portion of the ink guide projection 16 in the FIG. 1.

Ink guide dikes 50 are provided in an area of an upper surface of the head substrate 12, i.e., a bottom face of the ink passage 48 corresponding to the ejection orifice 38. The ink guide dikes 50 are provided in order to form an ink flow directed from an upstream side of the ink flow in the ink passage 48 toward the ejection orifice 38. A structure and an operation of each ink guide dike 50 will be described later.

Next, the counter electrode 18 is disposed in a position facing the ink guide tip portion 17 at a predetermined distance (e.g., 200 to 1,000 μm) from the ink guide tip portion 17. The counter electrode 18 includes an electrode substrate 40 and an insulating sheet 42. The electrode substrate 40 is grounded, and the insulating sheet 42 is formed on a surface of the electrode substrate 40 on the ink guide projection 16 side. The recording medium P is held on the surface of the insulating sheet 42, and the counter electrode (the insulating sheet 42) 18 functions as the platen of the recording medium P.

The charging unit 20 for the recording medium P includes a scorotron charger 44 for charging the recording medium P at a negative high voltage, and a bias voltage source 46 for supplying a negative high voltage to the scorotron charger 44. The scorotron charger 44 is disposed in a position facing the surface of the recording medium P at a predetermined distance from the surface of the recording medium P. In addition, a negative side terminal of the bias voltage source 46 is connected to the scorotron charger 44, and a positive side terminal of the bias voltage source 46 is grounded.

Note that the charging means of the charging unit 20 is not limited to the scorotron charger 44, and thus it is possible to use various charging means such as a corotron charging unit or a solid charger.

In recording an image, the surface of the insulating sheet 42 of the counter electrode 18, i.e., the recording medium P held thereon is charged at a predetermined negative high voltage opposite in polarity to the high voltage applied to the first ejection electrode 26 or the second ejection electrode 28, e.g., at −1.5 kV by the charging unit 20. As a result, the recording medium P is continuously biased by the charging unit 20 at a negative high voltage with respect to the first ejection electrode 26 or the second ejection electrode 28 and hence is electrostatically adsorbed on the insulating sheet 42 on the counter electrode 18.

Note that while the counter electrode 18 is constituted by the electrode substrate 40 and the insulating sheet 42, and the recording medium P is charged at the negative high voltage by the charging unit 20 to be electrostatically adsorbed on the surface of the insulating sheet 42, the present invention is not limited to this constituent. That is to say, there may be adopted a constitution that the counter electrode 18 is constituted by only the electrode substrate 40, the counter electrode (the electrode substrate 40 itself) 18 is connected to the bias voltage source 46 to be continuously biased at a negative high voltage, and under this condition, the recording medium P is electrostatically adsorbed on the surface of the counter electrode 18.

In addition, the electrostatic adsorption of the recording medium P on the counter electrode 18, and the electrostatic charge of the recording medium P at a negative high voltage or the application of a negative bias high voltage to the counter electrode 18 may also be carried out using different negative high voltage sources. Also, the means for holding the recording medium P on the counter electrode 18 is not limited to the electrostatic adsorption of the recording medium P, and hence any other suitable supporting method or support means may also be used for the recording medium P.

In the foregoing description, the method for driving the first and second ejection electrodes 26 and 28 has been described by giving the specific example in which the ink jet head includes the fifteen ejection portions. However, it should be noted that the number of ejection portions, the physical disposition of the ejection portions, and the like may be freely selected. For example, it is possible to one-dimensionally or two-dimensionally dispose a plurality of ejection portions to constitute the line head. In addition, the head units, the number of which corresponds to the number of used ink colors are provided to thereby be able to cope with the monochrome recording and the color recording.

Next, the structure of the ink guide dike 50 becoming a characteristic part of the present invention will hereinafter be described.

Figure 3A:
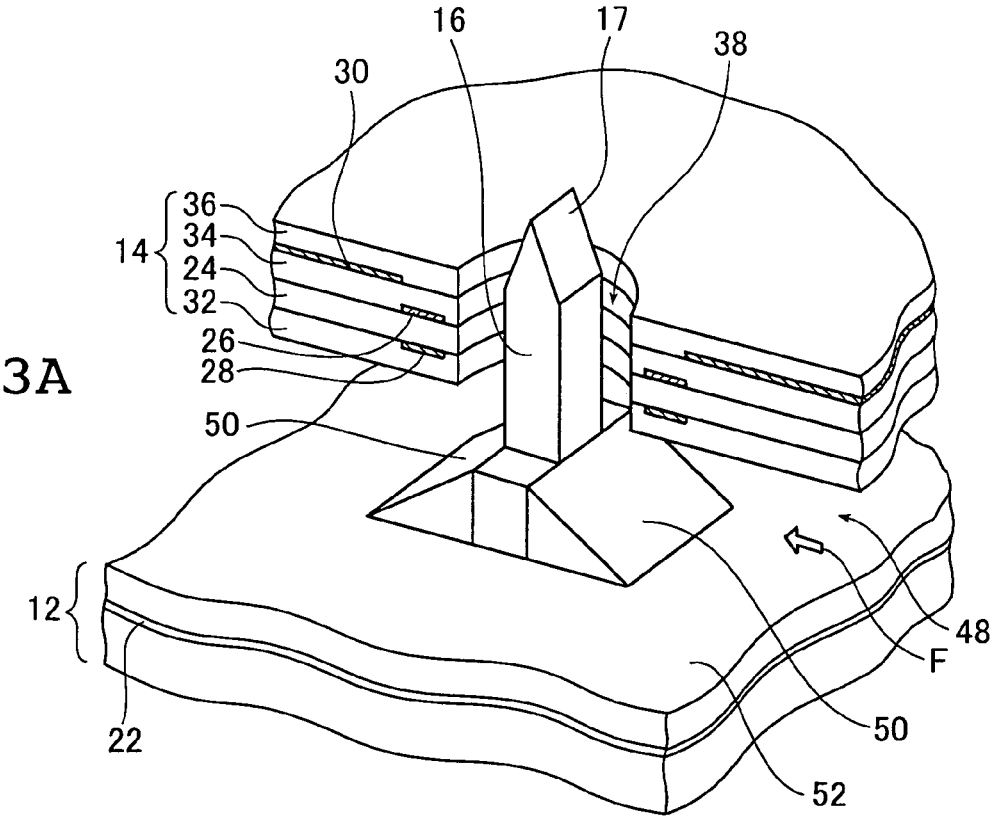
FIG. 3A is a partial cross sectional perspective view showing a construction in the vicinity of an ejection portion in the ink jet head shown in FIG. 1.

FIG. 3A is a partial cross sectional perspective view showing a construction of the vicinity of the ejection portion in the ink jet head 11 shown in FIG. 1. In the figure, in order to demonstrate clearly the structure of the ink guide dike 50, the ejection orifice substrate 14 is cut off in a nearly central position of the ink guide projection 16 along a direction of the ink flow.

The ink guide dikes 50 are respectively provided on upstream and downstream sides of the direction of the ink flow (the direction indicated by an arrow F) so as to correspond in position to the ink guide projection 16, which is disposed in a position corresponding to the ejection orifice 38, on a surface on the ink passage 48 side of the head substrate 12, i.e., on a bottom face of the ink passage 48. Also, each ink guide dike 50 has a surface which inclines so as to gradually close to the ejection orifice substrate 14 from the vicinity of the position corresponding to the ejection orifice 38 toward the position corresponding to the center of the ejection orifice 38 with respect to the direction of the ink flow. That is to say, each ink guide dike 50 has such a shape as to incline toward the ejection orifice 38 along the direction of the ink flow.

In addition, each ink guide dike 50 is constructed so as to have nearly the same width as that of the ejection orifice 38 and have side walls erected from the bottom face in respective directions each intersecting perpendicularly the direction of the ink flow. In addition, the ink guide dikes 50 are provided at a predetermined distance from the bottom face of the ejection orifice substrate 14 on the ink passage 48 side, i.e., the upper surface of the ink passage 48 so as to ensure the passage of the ink Q without blocking up the ejection orifice 38. Such ink guide dikes 50 are provided for each ejection portion.

The ink guide dikes 50 inclining toward the ejection orifice 38 are provided on the bottom face of the ink passage 48 along the direction of the ink flow, whereby the ink flow directed to the ejection orifice 38 is formed and hence the ink Q is guided to the opening portion of the ejection orifice 38 on the side of the ink passage 48. Thus, it is possible to suitably make the ink Q to flow into the inside of the ejection orifice 38, and it is also possible to enhance the supplying property of the ink Q to the ink guide tip portion 17 serving as the ejection portion for the ink droplet R. Consequently, the responsivity to the ejection frequency upon recording an image can be improved, and hence even when the dots are continuously drawn at a high speed, the dots each having a desired size can be stably drawn.

As a result, it is possible to prevent the ink Q from staying in the inside of the ejection orifice 38, and it is also possible to prevent the ejection orifice 38 from being clogged.

Figure 3B:
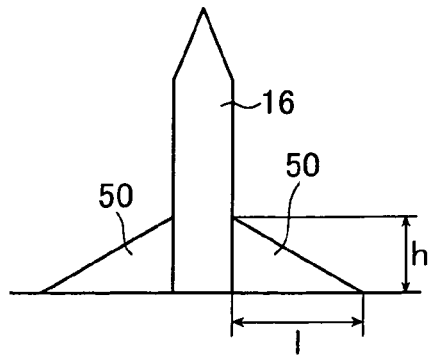
FIG. 3B is a schematic view explaining a shape and a size of an ink guide dike.

A length l of the ink guide dike 50 in the direction of the ink flow has to be suitably set so as to suitably guide the ink Q to the ejection orifice 38 within a range of not interfering with any of the adjacent ejection portions. Thus, as shown in FIG. 3B, the length l of the ink guide dike 50 is preferably 3 or more times as large as a height h ($l/h \geqq 3$) of a highest portion of the ink guide dike 50, and is more preferably 8 or more times as large as a height h ($l/h \geqq 8$) of the height of the highest portion of the ink guide dike 50.

A width of the ink guide dike 50 in the direction intersecting perpendicularly the direction of the ink flow is preferably equal to that of the ejection portion 38 or slightly wider than that of the ejection portion 38. In addition, the ink guide dike 50 is not limited to the illustrated example having a uniform width. Thus, there may also be adopted an ink guide dike having a gradually decreasing width, an ink guide dike having a gradually increasing width, or the like. In addition, each side wall of the ink guide dike 50 is not limited to the vertical plane, and hence may also be an inclined plane or the like.

An inclined plane (ink guide surface) of the ink guide dike 50 must have a shape which is suitable for guiding the ink Q to the ejection orifice 38. Thus, a slope having a fixed angle of inclination may be adopted for the inclined plane of the ink guide dike 50. Or, a surface having a changing angle of inclination, or a curved surface may also be adopted for the inclined plane of the ink guide dike 50. In addition, the exterior of the inclined plane of the ink guide dike 50 is not limited to a smooth surface. Thus, one or more ridges, grooves, or the like may be formed along the direction of the ink flow, or radially toward the central portion of the ejection orifice 38 on the inclined plane of the ink guide dike 50.

In addition, the upper portion of the ink guide dike 50 and the ink guide projection 16 may also be smoothly connected to each other without creating a step in the vicinity of a connection portion between the upper portion of the ink guide dike 50 and the ink guide projection 16 as in the illustrated example.

In the illustrated example, there is adopted a form in which the ink guide dikes 50 are disposed on the upstream and downstream sides of the ink guide projection 16, respectively. However, alternatively, there may also be adopted a form in which a trapezoidal ink guide dike 50 having slopes on the upstream and downstream sides of the ejection orifice 38, respectively, is provided, and the ink guide projection 16 is erected on the upper portion of this trapezoidal ink guide dike 50. Or, the ink guide projection 16 and the ink guide dike 50 may also be formed integrally with each other. As described above, the ink guide dike 50 may be formed separately from or integrally with the ink guide projection 16 to be mounted to the head substrate 12, or may also be formed by digging the head substrate 12 using the conventionally known digging means, etching means, or the like.

It should be noted that while the ink guide dike 50 has to be provided on the upstream side of the ejection orifice 38, as in the illustrated example, the ink guide dike 50 is preferably provided on the downstream side as well of the ejection orifice 38 so that its height in the direction of ejection of the ink droplet R becomes lower with increasing a distance from the ejection orifice 38. As a result, the ink Q which has been guided toward the ejection orifice 38 by the ink guide dike 50 on the upstream side smoothly flows into the downstream side. Hence, the stability of the ink flow can be held and also the stability of ejection of the ink Q can be maintained without a turbulent flow of the ink Q.

In addition, in the example shown in FIG. 3A, the ink guide dikes 50 are disposed on the upper surface of the head substrate 12. However, alternatively, as shown in FIG. 4, there may also be adopted a construction in which an ink flow groove 52 is provided in the head substrate 12, and the ink guide dikes 50 are disposed inside the ink flow groove 52.

Figure 4:
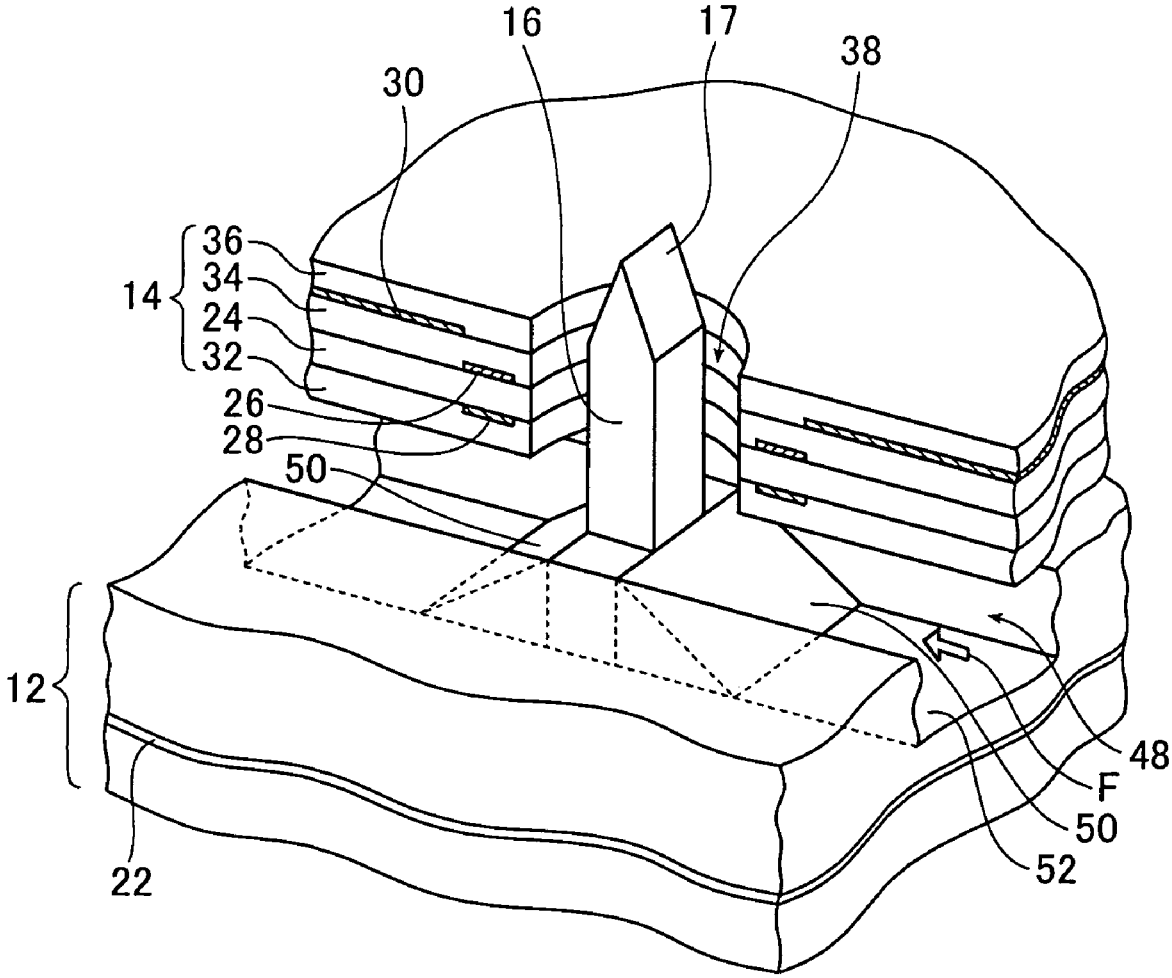
FIG. 4 is a partial cross sectional perspective view showing a construction in the vicinity of an ejection portion of the head substrate according to another embodiment of the present invention.

In another embodiment of the present invention shown in FIG. 4, the ink flow groove 52 having a predetermined depth is provided so as to extend through a position corresponding to the ejection orifice 38 along the direction of the ink flow (the direction indicated by the arrow F). In addition, a gap defined between the upper surface of the head substrate 12 other than the surface having the ink flow groove 52 formed thereon and the lower surface of the ejection orifice substrate 14 is narrower than that defined between the upper surface of the head substrate 12 and the lower surface of the ejection orifice substrate 14 shown in FIG. 3A. In such a manner, the provision of the ink flow groove 52 makes it possible to make most of the ink Q flowing through the ink passage 48 to selectively flow to the ink flow groove 52.

The ink guide dikes 50 each having a surface inclining toward the ejection orifice 38 along the direction of the ink flow, similar to the embodiment shown in FIGS. 3A and 3B, are provided in a position of the ink flow groove 52 corresponding to the ejection orifice 38. Thus, the ink Q flowing through the ink flow groove 52 is guided to the ejection orifice 38 by the ink guide dikes 50. As a result, the ink Q can be made to suitably flow into the inside of the ejection orifice 38, and hence it is possible to enhance the supplying property of the ink Q to the ink guide tip portion 17.

The ink flow groove 52 and the ink guide dikes 50 can be formed by processing the head substrate 12 using the conventionally known digging means, etching means, or the like.

Figure 5A:
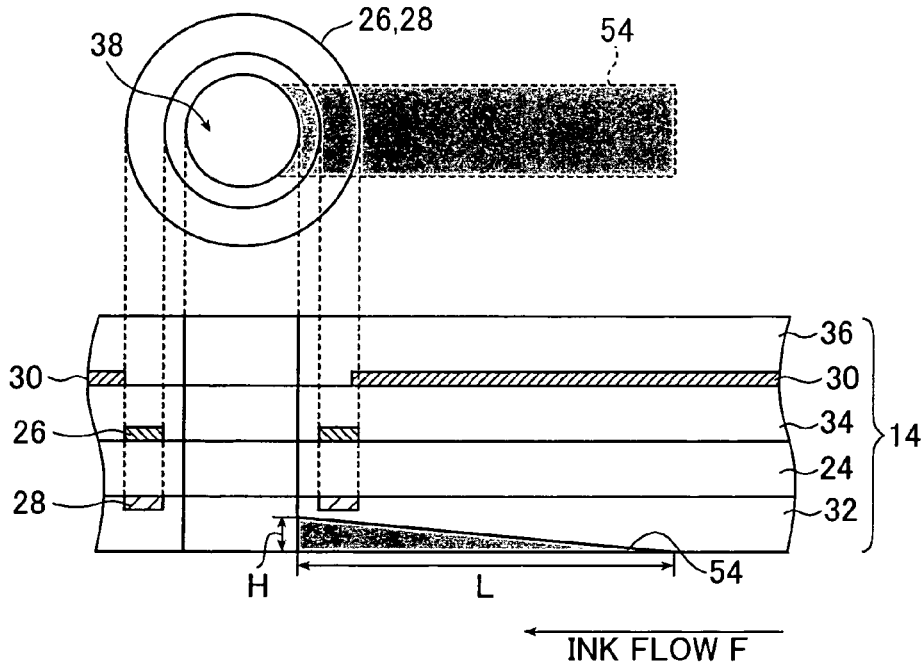
FIG. 5A is a schematic plan view and a schematic cross sectional view each showing a structure in the vicinity of the ejection orifice of the ejection orifice substrate.
Figure 5B:
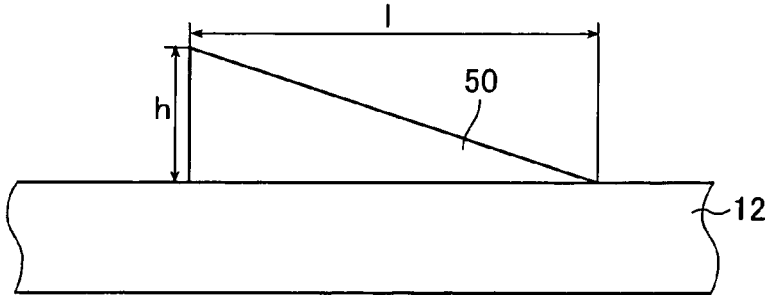
FIG. 5B is a schematic cross sectional view showing a structure of the head substrate and the ink guide dike in a position corresponding to the ejection orifice shown in FIG. 5A.

In order to further enhance the supplying property of the ink Q to the ejection orifice 38, for example, as shown in FIGS. 5A and 5B, it is also preferable to provide an ink guide groove in the lower surface of the ejection orifice substrate 14 on the ink passage 48 side. FIG. 5A is a structural plan view and a structural cross sectional view taken along a centerline of the ejection orifice 38 each showing an example of a structure of the ejection orifice substrate 14 in the vicinity of the ejection orifice 38. FIG. 5B is a structural cross sectional view showing the head substrate 12 and the ink guide dike 50 in a position corresponding to the ejection orifice 38 shown in FIG. 5A.

As shown in FIGS. 5A and 5B, an ink guide groove 54 is formed in the surface of the ejection orifice substrate 14 on the ink passage 48 side, i.e., in the surface of the insulating layer 32 on the ink passage 48 side so as to lead from the upstream side of the ink flow to the ejection orifice 38. In addition, the ink guide groove 54 is sloped at a predetermined angle so that its depth becomes gradually deeper from the upstream side of the ink flow to the ejection orifice 38.

In such a manner, the ink guide groove 54 leading to the ejection orifice 38 is provided to guide the ink Q into the ejection orifice 38 along the ink guide groove 54. Hence, it is possible to enhance the property of supply of the ink Q to the ejection orifice 38 and the ink guide tip portion 17.

Here, an angle of inclination and a shape of the ink guide groove 54 may be similar to those of the ink guide surface of the ink guide dike 50. Or, a gap between the ink guide dike 50 and the ink guide groove 54 may become narrower toward the ejection orifice 38 so that a flow velocity of the ink Q toward the inside of the ejection orifice 38 is increased.

Figure 6A:
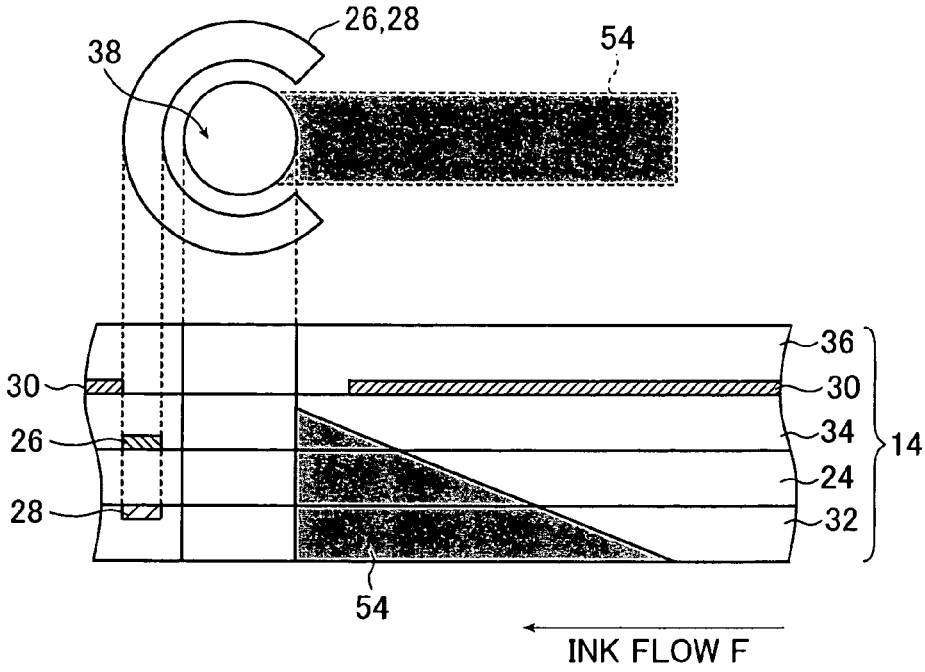
FIG. 6A is a schematic plan view and a schematic cross sectional view each showing another example of a structure in the vicinity of the ejection orifice of the ejection orifice substrate.
Figure 6B:
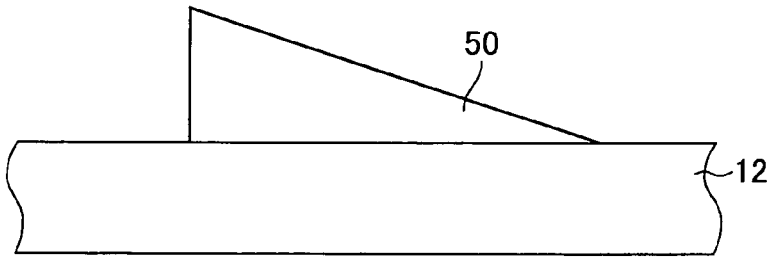
FIG. 6B is a schematic cross sectional view showing a structure of the head substrate and the ink guide dike in a position corresponding to the ejection orifice shown in FIG. 6A.
Figure 7:
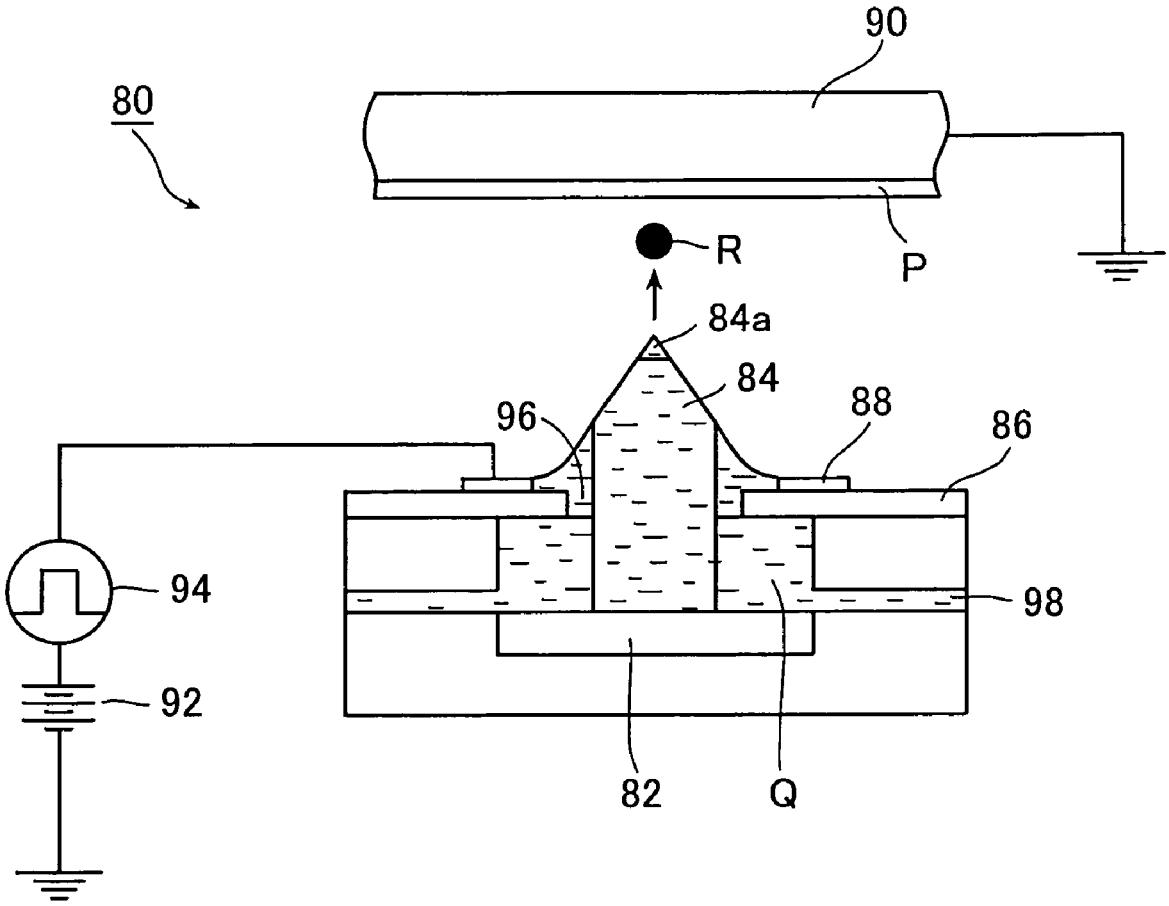
FIG. 7 PRIOR ART
FIG. 7 is a structural schematic view of an example of a conventional ink jet head.

Note that in a case where the ink guide groove 54 is provided, as shown in FIG. 6A, it is preferable that the first and second ejection electrodes 26 and 28 be formed into a circular arc shape with their parts on the upstream side of the ink flow being removed, and a portion of the ink guide groove 54 in the vicinity of the ejection orifice 38 is formed so as to extend in depth beyond the second ejection electrode 28. FIG. 6A is a structural plan view and a structural cross sectional view taken along a centerline of the ejection orifice 38 each showing another example of a structure of the portion of the ejection orifice substrate 14 in the vicinity of the ejection orifice 38. FIG. 6B is a schematic cross sectional view showing a structure of the head substrate 12 and the ink guide dike 50 in a position corresponding to the ejection orifice 38 shown in FIG. 6A. In such a manner, the ink guide groove 54 can be deeply formed to thereby further enhance the supplying property of the ink Q to the ejection orifice 38 and the ink guide tip portion 17.

A length L of the ink guide groove 54 in the direction of the ink flow has to be suitably set so as to suitably guide the ink Q to the ejection orifice 38 within a range of not interfering with any of the adjacent ejection portions. Then, in order to guide the ink Q to the ejection orifice 38 while a commutated flow of the ink Q is kept, as shown in FIG. 5B for example, the length L of the ink guide groove 54 in the direction of the ink flow is preferably 3 or more times as large as a maximum depth H (L/H≧3) of the ink guide groove 54, and is more preferably 8 or more times as large as the maximum depth H (L/H≧8) of the ink guide groove 54.

The ink guide groove 54 may be formed at a fixed depth in the direction of the ink flow. In addition, a width of the ink guide groove 54 may be uniform in the direction of the ink flow. Or, the ink guide groove 54 may become narrower in width toward the upstream side of the ink flow. Or, the ink guide groove 54 may become narrower in width toward the ejection orifice 38 side. In addition, a cross sectional shape of the ink guide groove 54 is preferably a trapezoidal shape or an inverted triangular shape in which its width becomes narrower as its depth becomes deeper. Also, only one guide groove 54 may be adopted, or a plurality of grooves leading to the ejection orifice 38 may also be formed.

Note that while the length, width, depth, plane shape, cross sectional shape, and the like of the ink guide dike 50, the ink flow groove 52, and the ink guide groove 54 are not limited at all, however, since the property of supply of the ink Q to the ejection orifice 38 changes in correspondence to these settings, these factors are preferably and suitably set as may be necessary.

Next, a description will hereinafter be given with respect to the ink Q used in the ink jet head 11 in the recording apparatus 10.

A liquid material in which charged color particles (colored and charged fine particles) each having a particle diameter of about 0.1 to about 5.0 μm are dispersed into a carrier liquid is used as the ink Q. Note that disperse resin particles for enhancing the fixing property of an image after printing may be suitably contained in the ink Q. In addition, the carrier liquid is preferably a dielectric liquid (nonaqueous solvent) having a high electrical resistivity (equal to or larger than $10^9$ Ω·cm, preferably equal to or larger than $10^{10}$ Ω·cm, and preferably equal to or smaller than $10^{16}$ Ω·cm).

When the dielectric liquid having a high electrical resistivity is used as the carrier liquid, it is possible to reduce that the carrier liquid itself suffers the injection of the electric charges due to the applied voltage to the ejection electrode, and hence it is possible to concentrate the charged particles. In addition, the carrier liquid having a high electrical resistivity may contribute prevention of the electrical conduction between the adjacent ejection portions. Also, when the ink containing the carrier liquid having the electrical resistivity falling within the above-mentioned range is used, the ink can be satisfactorily ejected even in the low electric field.

In addition, a relative permittivity of the carrier liquid is preferably equal to or smaller than 5, more preferably equal to or smaller than 4, and much more preferably equal to or smaller than 3.5. Its lower limit is desirably about 1.9. Such a range is selected for the relative permittivity of the carrier liquid, whereby the electric field effectively acts on the charged particles in the dielectric liquid to cause the charged particles to be easy to migrate. As a result, the polarization of the solvent can be suppressed to allow relaxation of the electric field to be suppressed. Thus, it is possible to form the dot which has satisfactory image concentration and which is less in bleeding.

As for the carrier liquid, preferably, it is possible to use straight chain or branch chain aliphatic hydrocarbon and alicyclic hydrocarbon, aromatic hydrocarbon, a halogen substitution product of these hydrocarbons, and the like.

More specifically, as the carrier liquid, for example, it is possible to singly or mixedly use hexane, heptane, octane, isooctane, decane, isodecane, decalin, nonane, dodecane, isododecane, cyclohexane, cyclooctane, cyclodecane, benzene, toluene, xylene, mesitylene, isopar C, isopar E, isopar G, isopar H, isopar L (isopar: a trade name of a liquid material made by EXXON MOBILE CORPORATION), shellsol 70, shellsol 71 (shellsol: a trade name of a liquid material made by SHELL OIL CO., LTD.), amsco OMS solvent, amsco 460 solvent (amsco: a trade name of a liquid material made by SPIRITS CO., LTD.), silicone oil (e.g., KF-96L made by SHIN-ETSU CHEMICAL CO., LTD.) or the like.

With respect to the color particles, the colorant may be directly dispersed into a dielectric liquid, or may be indirectly dispersed into a dielectric liquid after being contained in disperse resin particles for enhancement of fixing property. In the case where the colorant is contained in the disperse resin particles, in general, there is adopted a method in which the pigments or the like are covered with the resin material of the disperse resin particles to obtain the particles covered with the resin, and the disperse resin particles are colored with the dyes or the like to obtain the color particles. In addition, as for the colorant, all the pigments and dyes used in the ink composite for ink jet, the (oiliness) ink composite for printing, or the liquid developer for electrostatic photography may be used.

In addition, a content of color particles (a total content of coloring particles and resin particles) preferably falls within a range of 0.5 to 30.0 weight % for the overall ink from a viewpoint of concentration of the printed image, formation of uniform disperse liquid, and suppression of clogging of the ink in the ejection heads, more preferably falls within a range of 1.5 to 25.0 weight %, and much more preferably falls within a range of 3 to 20 weight %.

As for the pigment used as the colorant, ones which are generally used in the technical field of the printing may be used herein irrespective of the inorganic pigment or the organic pigment.

More specifically, as for the pigment used as the colorant, various pigments such as carbon black, cadmium red, molybdenum red, chromium yellow, cadmium yellow, titanium yellow, chromium oxide, vyridian, cobalt green, ultramarine blue, pursian blue, cobalt blue, azo series pigments, phthalocyanine series pigments, quinacridone series pigments, isoindolinone series pigments, dioxazin series pigments, indanthrene series pigments, perylene series pigments, perynone series pigments, thioindigo series pigments, quinophthalone series pigments, and a metallic complex pigment, or the like can be used without being especially limited.

In addition, as for the dye used as the colorant, there is preferable an oil soluble dye such as an azodye, a metal complex dye, a naphthol dye, an anthraquinone dye, an indigo dye, a carbonium dye, a quinonimine dye, a xanthene dye, an aniline dye, a quinoline dye, a nitro dye, a nitroso dye, a benzoquinone dye, a naphthoquinone dye, a phthalocyanine dye, or a metal phthalocyanine dye.

Also, an average particle diameter of the color particles preferably falls within a range of 0.1 to 5.0 μm, more preferably falls within a range of 0.2 to 1.5 μm, and much more preferably falls within a range of 0.4 to 1.0 μm. These particle diameters are measured with CAPA-500 (a trade name of a measuring apparatus manufactured by HORIBA LTD.).

Note that the color particles in the ink Q are preferably the charging detectable particles which are positively or negatively charged. Giving the color particles the charging detectability can be realized by suitably utilizing the technique of the developer for wet electrostatic photography.

More specifically, giving the color particles the charging detectability is attained by using the charging detectable materials described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY—BASES AND APPLICATIONS", edited by THE IMAGING SOCIETY OF JAPAN, and published by CORONA PUBLISHING CO., LTD., pp 497 to 505, 1988; and "ELECTRONIC PHOTOGRAPHY", by Yuji Harasaki, 16(No. 2), p.44, 1977, and other addition agents.

In addition, the viscosity of the ink composite is preferably in a range of 0.5 to 5.0 mPa·sec, more preferably in a range of 0.6 to 3.0 mPa·sec, and much more preferably in a range of 0.7 to 2.0 mPa·sec. The color particles are charged, and various charging control agents which are used in the liquid developer for electronic photograph as may be necessary can be used therein. A charging amount thereof is preferably in a range of 5 to 200 μC/g, more preferably in a range of 10 to 150 μC/g, and much more preferably in a range of 15 to 100 μC/g.

The electrical resistance of the dielectric liquid may be changed by adding the charging control agent in some cases. Thus, a distribution factor P defined below is preferably equal to or larger than 50%, more preferably equal to or larger than 60%, and much more preferably equal to or larger than 70%.

$$P=100\times(\sigma1-\sigma2)/\sigma1$$

where σ1 is an electric conductivity of an ink composite, and σ2 is an electric conductivity of a supernatant liquid which is obtained by inspecting the ink composite with a centrifugal separator.

These electric conductivities were obtained by measuring the electric conductivities of the ink composite and the supernatant liquid under a condition of an applied voltage of 5 V and a frequency of 1 kHz using an LCR meter of an AG-4311 type (manufactured by ANDO ELECTRIC CO., LTD). and an electrodes for liquids of an LP-05 type (manufactured by KAWAGUCHI ELECTRIC WORKS, CO., JP). In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink composite as described above is adopted, which results in that the colored and charged particles become easy to migrate and hence the colored and charged particles become easy to be concentrated.

On the other hand, the electric conductivity σ1 of the ink composite is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent recording electrodes.

In addition, a surface tension of the ink composite is preferably in a range of 15 to 50 mN/m, more preferably in a range of 15.5 to 45.0 mN/m, and much more preferably in a range of 16 to 40 mN/cm. The surface tension is set to this range, resulting in that the applied voltages to the ejection electrodes are not excessively high, and also the ink does not leak and spread to the periphery of the head to contaminate the head.

The ink jet head 11 does not apply a force to the overall ink to fly the ink droplet R towards the recording medium P, but applies a force to the charged color particles dispersed into a carrier liquid to fly the ink droplet R towards the recording medium P. As a result, an image can be recorded on various recording media such as not only a plain paper but also a non-absorption film, e.g., a PET film. In addition, an image of high image quality can be recorded on various recording media without running and flowing thereon.

Next, an operation of the electrostatic ink jet recording apparatus 10 will be described based on an example of a case where the color particles contained in the ink Q are positively charged.

In recording an image, the ink Q is made to circulate through the ink passage 48 from the right-hand side to the left-hand side in FIG. 1 (in a direction indicated by an arrow F in FIG. 1) at a predetermined velocity by a circulation mechanism for ink (not shown).

At this time, the color particles contained in the ink Q within the ink passage 48 are energized by the floating conductive plate 22 to pass through the ejection orifice 38 to be concentrated at the tip portion of the ink guide projection 16. Thus, the positively charged color particles within the ink Q are stabilized at predetermined concentration all the time. In addition, since the ink Q is guided to the orifice of the ejection orifice 38 on the side of the ink passage 48 along the ink guide dike 50, it is possible to enhance the property of supply of the ink Q to the ejection orifice 38 and the ink guide tip portion 17.

On the other hand, the recording medium P is charged at a negative high voltage (e.g., at −1.5 kV) by the charging unit 20, and is transported from the front to the back of the paper in FIG. 1 at a predetermined velocity by transporting means (not shown) while being electrostatically adsorbed on the insulating sheet 42 on the counter electrode 18.

The second ejection electrodes 28 are set at a high voltage level (e.g., at 400 to 600 V) or in a high impedance state (in an ON state) in order one row by one row by the control means, and all the remaining second ejection electrodes 28 are driven at the ground level (the ground state, i.e., in an OFF state). On the other hand, the first ejection electrodes 26 are simultaneously driven at a high voltage level or at the ground level on a column-by-column basis in correspondence to the image data. As a result, the ejection/non-ejection of the ink in each of the ejection portions is controlled.

That is to say, when the second ejection electrode 28 is at the high voltage level or in the high impedance state, and also the first ejection electrode 26 is at the high voltage level, the ink Q is ejected in the form of the ink droplet R. On the other hand, when at least one of the first and second ejection electrodes 26 and 28 is at the ground level, no ink is ejected. Then, the ink droplets R ejected from the respective ejection portions are attracted to the recording medium P charged at the negative high voltage to be stuck onto predetermined positions on the recording medium P, respectively, to form an image.

At this time, as described above, the provision of the ink guide dike 50 forming an ink flow directed toward the ejection orifice 38 and leading the ink Q to the ejection orifice 38 enhances the property of supply of the ink Q to the ejection orifice 38. For this reason, the responsivity to the ejection frequency in recording an image is improved. Thus, even when the dots are continuously drawn at a high speed, it is possible to suppress reduction of the dot diameter, and hence it is possible to stably draw the dots each having a desired size. In other words, it is possible to record an image of high image quality having no dispersion in dot sizes.

While in the above-mentioned embodiments, the ink guide projection 16 is disposed in the position corresponding to the ejection orifice 38, even in the ink jet head having no ink guide projection 16, the ink guide dikes 50 are provided in the position corresponding to the ejection orifice 38 to thereby form the flow of the ink Q directed to the ejection orifice 38. Hence, it is possible to enhance the supplying property of the ink Q to the ejection orifice 38.

At that, as described above, when the rows of the second ejection electrodes 28 as the lower layer are successively turned ON, and the first ejection electrodes 26 as the upper layer are turned ON/OFF in correspondence to the image data, the first ejection electrodes 26 are driven in correspondence to the image data. Thus, when the individual ejection portions in the column direction are supposed to be the centers, in the ejection portions on the both sides of each central ejection portion, the levels of the first ejection electrodes 26 are changed frequently to the high voltage level or to the ground level. In this case, the guard electrode 30 is biased at a predetermined guard potential, e.g., at the ground level or the like in recording an image, thereby excluding influences of electric fields of the adjacent ejection orifices.

In addition, as another embodiment, the first and second ejection electrodes 26 and 28 can also be driven in opposite states. That is, the first ejection electrodes 26 can be successively driven one column by one column, and the second ejection electrodes 28 can be driven in correspondence to the image data.

In this case, with respect to the column direction, the first ejection electrodes 26 are driven one column by one column, and when the individual ejection portions in the column direction are supposed to be the centers, the first ejection electrodes 26 of the ejection portions on the both sides of each central ejection portion in the column direction become the ground level all the time. Thus, the first ejection electrodes 26 of the ejection portions on the both sides of each central ejection portion in the column direction function as the guard electrode 30. In the case where the first ejection electrodes 26 as the upper layer are successively turned ON one column by one column, and the second ejection electrodes 28 as the lower layer are driven in correspondence to the image data, even if no guard electrode 30 is provided, the influences of the adjacent ejection portions can be excluded to enhance the recording quality.

In the ink jet head 11, whether the control for the ink ejection/non-ejection is carried out using one of or both of the first ejection electrodes 26 and the second ejection electrodes 28 is not a limiting factor at all. That is to say, the voltages of the ejection electrode side and the recording medium P side have to be suitably set so that when a difference between the voltage value of the ejection electrode side during the ink ejection/non-ejection, and the voltage value of the recording medium P side is larger than a predetermined value, the ink is ejected, while when the difference is smaller than the predetermined value, no ink is ejected.

In addition, while in each of the above-mentioned embodiments, the color particles contained in the ink are positively charged, and the recording medium P side is charged at a negative high voltage, the present invention is not limited thereto. That is to say, conversely, the color particles in the ink may be negatively charged, and the recording medium P side may be charged at a positive high voltage. In such a manner, when the polarity of the color particles is reversed to that of the color particles in each of the above-mentioned embodiments, the polarities or the like of the applied voltages to the counter electrode 18, the charging unit 20 for the recording medium P, and the first and second ejection electrodes 26 and 28 of each of the ejection portions have to be reversed to those in each of the above-mentioned embodiments.

In addition, though the overall construction of the ink jet recording apparatus of the present invention is not illustrated, the ink jet recording apparatus of the present invention serves to record an image corresponding to image data on a recording medium using the ink jet head of the present invention. Thus, the ink jet recording apparatus of the present invention has to include basic mechanisms, which an image recording apparatus such as an ink jet recording apparatus normally includes, such as supply means and conveyance means for a recording medium, in addition to the constituent elements which have been described above in detail.

Note that the present invention is not limited to the electrostatic ink jet head and the electrostatic ink jet recording apparatus, and hence can be applied to various ink jet heads and ink jet recording apparatuses using the ejection control means for ink, such as the thermal type one and the piezo type one.

The present invention is basically as described above.

While above, the ink jet head and the ink jet recording apparatus of the present invention have been described in detail, it is to be understood that the present invention is not limited to the above-mentioned embodiments, and hence various improvements and changes may be made without departing from the subject matter of the present invention.

What is claimed is:

1. An ink jet head for ejecting ink in a form of an ink droplet to fly the ink droplet toward a recording medium, comprising:

an ejection orifice substrate in which an ejection orifice adapted to eject therefrom the ink is bored;

a head substrate disposed at a predetermined distance from said ejection orifice substrate to define an ink passage between said ejection orifice substrate and said head substrate;

ejection control means for controlling the ejection of the ink from said ejection orifice;

an ink guide dike provided on a surface of said head substrate on a side of said ink passage to form an ink flow directed from an upstream side of said ejection orifice in said ink passage to said ejection orifice; and an ink guide projection disposed on said head substrate so as to extend through a central portion of said ejection orifice with its tip being directed in a direction of the ejection of the ink, wherein said ink guide dike is provided so as to contact said ink guide projection.

2. The ink jet head according to claim 1, wherein said ink guide dike includes a surface inclining in a direction from said surface of said head substrate on the side of said ink passage to said ejection orifice substrate so as to lead from the upstream side of said ejection orifice in said ink passage toward a position of said ejection orifice.

3. The ink jet head according to claim 1, further comprising:

an ink guide groove formed in a surface of said ejection orifice substrate on the side of said ink passage so as to lead from the upstream side of said ejection orifice in said ink passage to said ejection orifice.

4. The ink jet head according to claim 3, wherein:

said ejection electrode is formed into a circular arc shape with its part of the electrode on the upstream side of said ejection orifice in said ink passage being removed; and said ink guide groove is formed so as to extend through said removed portion of said ejection electrode to reach in depth a position nearer said recording medium than said ejection electrode formed in the position nearest said recording medium.

5. The ink jet head according to claim 1, wherein:

the ink contains a solvent and color particles dispersed in said solvent;

said ejection control means is comprised of an ejection electrode; and an electrostatic force is made to act on the ink by said ejection electrode to eject the ink in the form of the ink droplet, thereby flying the ink droplet toward said recording medium.

6. The ink jet head according to claim 5, wherein:

said ejection orifice substrate includes an insulating substrate and at least one layer of said ejection electrode provided on a surface of at least one of a side of said ink passage of said insulating substrate and a side of said recording medium of said insulating substrate so as to surround a periphery of said ejection orifice.

7. The ink jet head according to claim 1, wherein the ink passage has ink flow passing from a first side to a second side about the ejection orifice, and wherein the ink guide dike has a first portion to form the ink flow directed from the first side to said ejection orifice and a second portion to keep a stability of the ink flow directed from said ejection orifice to the second side.

8. The ink jet head of claim 7, wherein the ink guide dike extends only in the directions of the first and second sides in said ink passage.

9. The ink jet head according to claim 1, wherein a length of the ink guide dike is three or more times as large as a maximum height thereof.

10. An ink jet recording apparatus for recording an image corresponding to image data on a recording medium using an ink jet head for ejecting ink in a form of an ink droplet, said ink jet head comprising:

an ejection orifice substrate in which an ejection orifice adapted to eject therefrom the ink is bored;

a head substrate disposed at a predetermined distance from said ejection orifice substrate to define an ink passage between said ejection orifice substrate and said head substrate;

ejection control means for controlling the ejection of the ink from said ejection orifice;

an ink guide dike provided on a surface of said head substrate on a side of said ink passage to form an ink flow directed from an upstream side of said ejection orifice in said ink passage to said ejection orifice; and an ink guide projection disposed on said head substrate so as to extend through a central portion of said ejection orifice with its tip being directed in a direction of the ejection of the ink, wherein said ink guide dike is provided so as to contact said ink guide projection.

11. The ink jet recording apparatus according to claim 10, wherein said ink guide dike includes a surface inclining in a direction from said surface of said head substrate on the side of said ink passage to said ejection orifice substrate so as to lead from the upstream side of said ejection orifice in said ink passage toward a position of said ejection orifice.

12. The ink jet recording apparatus according to claim 10, further comprising:

an ink guide groove formed in a surface of said ejection orifice substrate on the side of said ink passage so as to lead from the upstream side of said ejection orifice in said ink passage to said ejection orifice.

13. The ink jet recording apparatus according to claim 12, wherein:

said ejection electrode is formed into a circular arc shape with its part of the electrode on the upstream side of said ejection orifice in said ink passage being removed; and said ink guide groove is formed so as to extend through said removed portion of said ejection electrode to reach in depth a position nearer said recording medium than said ejection electrode formed in the position nearest said recording medium.

14. The ink jet recording apparatus according to claim 10, wherein:

the ink contains a solvent and color particles dispersed in said solvent;

said ejection control means is comprised of an ejection electrode; and an electrostatic force is made to act on the ink by said ejection electrode to eject the ink in the form of the ink droplet, thereby flying the ink droplet toward said recording medium.

15. The ink jet recording apparatus according to claim 14, wherein:

said ejection orifice substrate includes an insulating substrate and at least one layer of said ejection electrode provided on a surface of at least one of a side of said ink passage of said insulating substrate and a side of said recording medium of said insulating substrate so as to surround a periphery of said ejection orifice.

16. An ink jet head for ejecting ink in a form of an ink droplet to fly the ink droplet toward a recording medium, comprising:

an ejection orifice substrate in which an ejection orifice adapted to eject therefrom the ink is bored;

a head substrate disposed at a predetermined distance from said ejection orifice substrate to define an ink passage between said ejection orifice substrate and said head substrate;

ejection control means for controlling the ejection of the ink from said ejection orifice;

an ink guide dike provided on a surface of said head substrate on a side of said ink passage to form an ink flow directed from an upstream side of said ejection orifice in said ink passage to said ejection orifice; and an ink guide groove formed in a surface of said ejection orifice substrate on the side of said ink passage so as to lead from the upstream side of said ejection orifice in said ink passage to said ejection orifice.

17. An ink jet recording apparatus for recording an image corresponding to image data on a recording medium using an ink jet head for ejecting ink in a form of an ink droplet, said ink jet head comprising:

an ejection orifice substrate in which an ejection orifice adapted to eject therefrom the ink is bored;

a head substrate disposed at a predetermined distance from said ejection orifice substrate to define an ink passage between said ejection orifice substrate and said head substrate;

ejection control means for controlling the ejection of the ink from said ejection orifice;

an ink guide dike provided on a surface of said head substrate on a side of said ink passage to form an ink flow directed from an upstream side of said ejection orifice in said ink passage to said ejection orifice; and an ink guide groove formed in a surface of said ejection orifice substrate on the side of said ink passage so as to lead from the upstream side of said ejection orifice in said ink passage to said ejection orifice.

* * * * *